United States Patent [19]

Cadwell

[11] 4,420,549

[45] Dec. 13, 1983

[54] LITHOGRAPHIC SUBSTRATE AND ITS PROCESS OF MANUFACTURE

[75] Inventor: Donald E. Cadwell, St. Paul, Minn.

[73] Assignee: Minnesota Mining and Manufacturing Company, St. Paul, Minn.

[21] Appl. No.: 299,721

[22] Filed: Sep. 8, 1981

[51] Int. Cl.[3] ..... G03C 1/94

[52] U.S. Cl. ..... 430/158; 430/161; 430/276; 430/278; 430/302

[58] Field of Search ..... 106/67, 39, 14.12; 430/65, 925, 158, 161, 276, 278, 302; 204/129, 95

[56] References Cited

U.S. PATENT DOCUMENTS

| | | | |
|---|---|---|---|
| 2,425,151 | 8/1947 | Greger | 106/67 |
| 2,425,152 | 8/1947 | Greger et al. | 106/67 |
| 2,995,453 | 8/1961 | Nobel et al. | 106/39 |
| 3,210,184 | 10/1965 | Uhlig | 430/65 |
| 3,963,594 | 6/1976 | Brasko | 204/129.95 |
| 3,975,197 | 8/1976 | Mikelsons | 430/925 |
| 4,319,924 | 3/1982 | Collins, Jr. et al. | 106/14.12 |

OTHER PUBLICATIONS

Webster's New Collegiate Dictionary, 1961, G. C. Merriam Co., p. 135.

Morris et al., Chem. Society Reviews, 6(2), 1977, pp. 173–195.

Gongalez et al., Bull. Am. Cer. Soc., vol. 59, No. 7, (1980), pp. 727–738.

Chemical Society Reviews 6 (2), 1977, "The Chemistry and Binding Properties of Aluminium Phosphates" by J. H. Morris, P. G. Perkins, A. E. A. Rose and W. E. Smith, pp. 173–195.

Bull. Am. Cer. Soc., vol. 59, No. 7, (1980), "Reaction of Orthophosphoric Acid with Several Forms of Aluminum Oxide", by F. J. Gonzalez and J. W. Halloran, pp. 727–738.

*Primary Examiner*—Thomas J. Herbert, Jr.

*Attorney, Agent, or Firm*—Donald M. Sell; James A. Smith; David L. Weinstein

[57] ABSTRACT

Lithographic printing substrates ordinarily require a mechanical or chemical graining of aluminum surfaces. Such substrates are difficult and expensive to make. It has been found that a lithographically suitable substrate on an aluminum surface can be provided by the firing of monoaluminum phosphate solutions on substrates having an aluminum surface.

7 Claims, No Drawings

LITHOGRAPHIC SUBSTRATE AND ITS PROCESS OF MANUFACTURE

BACKGROUND OF THE INVENTION

Lithographic printing plates have been widely used for many years. One of the basic concepts utilized in that technology is the establishment of differential wettability between areas on the planographic printing surface. This is most usually effected by providing a substrate having a hydrophilic or water wettable surface and coating that surface with an imageable and developable (usually light or radiation sensitive) grease sensitive (oleophilic) and hydrophobic layer. After imaging and developing of this layer, the printing plate variously exposes hydrophilic and hydrophobic surfaces. When the plate is then wet with water and then coated with grease or oil-based printing inks, only the hydrophobic areas of the image will hold the ink and provide a dark image when pressed against a receiving surface such as paper.

This lithographic process has been able to provide planographic printing plates which are capable of producing as few as hundreds of copies or as many as several hundred thousand high quality copies. The desirability of being able to produce large numbers of copies from a single plate are quite apparent. Only a single imaging and developing procedure must be performed, and the printing press need not be shut down during operation in order to change plates.

The investigation of means for lengthening the running time of planographic printing plates has been the focus of many studies and research. It is also necessary in the provision of more durable plates to maintain or improve such other desirable or essential characteristics of printing plates such as imaging speed, ease of development, non-polluting chemistry, and shelf life. Most of the research in providing longer running and higher durability planographic printing plates has centered on the imageable and hydrophobic coating layer on the hydrophilic surface of the substrate. As it is usually the breakdown of this layer which causes failure of the printing plate, the logic of that direction of research is apparent.

In general, the substrate provided for the imageable layer is an aluminum sheet which has been prepared for coating by a variety of cleaning, mechanical, and chemical treatments. For example, an aluminum surface is usually cleaned to remove oils and other contaminants. This cleaning is then followed by a mechanical or electrochemical graining process, and finally an anodizing process.

For example, U.S. Pat. No. 3,963,594 discloses the electrochemical etching of an aluminum substrate with an aqueous solution of hydrochloric acid and gluconic acid. This provides a uniformly coarse surface texture to the aluminum substrate. The process of that patent permits the use of lower current densities than were found to be necessary when using only hydrochloric acid in the bath. The treatment also complexed dissolved aluminum and other impurities which form in the etching bath. This extended the life of the bath. Desmutting treatments were also shown in combination with the electrochemical etching.

British Pat. No. 1,439,127 discloses an anodizing treatment for aluminum substrates in which the anodization is performed in an aqueous sulfuric acid bath at a temperature in excess of 70° C. and with an anodizing current density of at least 50 amps/sq. ft. This treatment reduces the length of time in which the anodizing step is performed. Other etching solution compositions and electrical parameters are disclosed in U.S. Pat. Nos. 4,072,589 and 4,052,275 and French Pat. No. 2,322,015.

U.S. Pat. No. 3,030,210 and French Pat. No. 2,025,550 disclose lithographic plate substrates prepared by immersion in phosphate-containing solutions, rinsing, and drying. The phosphate-containing layer produced by such a method is comparatively thin, soft and hydrated and does not have the intrinsic wear-resisting properties conferred by firing a ceramic coating at elevated temperatures.

After electrochemical or mechanical etching of the aluminum surface, an anodically oxidizing treatment is usually performed to render the aluminum surface both corrosion resistant and wear resistant. This is shown in British Pat. No. 1,439,127 discussed above and in U.S. Pat. No. 4,131,518. In this latter patent, aluminum foil in the form of a continuous web, particularly when the aluminum carries a polymeric coating on one side thereof, is anodized so that energy requirements are reduced and anodizing speeds are increased.

U.S. Pat. No. 3,181,461 discloses an anodizing process in which the sulfuric acid anodizing step is followed by treatment with an aqueous solution of sodium silicate. This treatment seals the pores of the anodic oxide and provides a hydrophilic, ink-repelling surface layer.

The practice of treating lithographic substrates of aluminum in order to increase surface areas and enable anodic coatings is well described in the art such as U.S. Pat. Nos. 3,935,080; 3,929,591; 3,980,539; and 3,988,217.

Even though anodizing has become the most common means of providing an aluminum substrate for durable planographic printing plates, and even though some reduction of energy requirements has been made, the process still requires large amounts of electrical energy in its operation and also generates effluents that must be carefully disposed of to avoid environmental pollution.

A novel method for providing textured surfaces on lithographic printing plate substrates of aluminum was disclosed in U.S. Pat. No. 3,210,184. A layer of boehmite (aluminum oxide monohydrate) was produced on the aluminum substrate by bathing the aluminum in hot water or steam in the presence of a weak organic base. Printing plates using this textured substrate were shown to provide increased numbers of copies under comparable conditions as compared to printing plates using mechanically roughened aluminum substrates.

German Pat. (Offenlegungsschrift) No. 24 34 098 discusses firing a composition of aluminum phosphate and silicon carbide particles onto a metal surface for the purpose of increasing its wear resistance. However, the invention of German Pat. No. 24 34 098 is not suitable for use on lithographic plates and is not performed on aluminum surfaces.

U.S. Pat. Nos. 3,871,881 and 3,975,197 disclose another method of enhancing the physical properties of aluminum surfaces. Various types of particulate material are bonded to the surface of the aluminum by an in situ formed binder of aluminum hydroxyoxide. The enhanced aluminum article is suggested for use as a substrate for printing plates.

It is disclosed in the description of the present invention that a novel process for treating lithographic quality aluminum foil can provide a durable, long-running substrate for lithographic plate constructions. This process provides a novel substrate which can be resistant to the chemical action of printing plate developers and press solvents. The novel substrate also enables the bonding of many photoreactive imaging layers to the treated aluminum substrate without the need for primers or other adhesion promoting agents.

SUMMARY OF THE INVENTION

A process is disclosed for firing a solution of monoaluminum phosphate on an aluminum substrate or aluminized surface of a substrate. This process produces an aluminum sheet bearing a layer of glass or polymorphic forms of aluminum phosphate or mixtures of aluminum phosphates on at least one surface thereof. This coated layer has been found to provide an excellent surface for adhesion of organic materials. In particular, the aluminum phosphate layer provides excellent adhesion for diazonium resins and photopolymeric compositions used in the printing art and particularly in the planographic printing art.

DETAILED DESCRIPTION OF THE INVENTION

The process of forming aluminum phosphate coatings on substrates according to the present invention provides a number of improvements over prior art processes for producing substrates for photoimaging elements, particularly in the continuous manufacture of substrates. Not only does the coated substrate of the present invention have equivalent or improved properties as compared to materials of the prior art, but also provides significant economic advantages in its manufacture. Apparatus used in the process consists of fewer separate items of equipment, thus requiring a lower capital investment than conventional forms of continuous substrate formation. The significant equipment eliminated includes the anodizing facility which is itself costly to operate because of high energy requirements and the need for safe effluent disposal. Such equipment is desirably eliminated from a substrate manufacturing line because of associated electrochemical corrosion problems of other equipment on the same production line.

A coating of a monoaluminum phosphate solution is applied to a clean aluminum or aluminized surface. This coating is fired at a temperature of at least 450° F. (230° C.), preferably at least 500° or 550° F. (260° or 290° C.), to produce a ceramic coating of a glass or polymorphic form of aluminum phosphate or mixture of aluminum phosphates. The ceramic surface may be etched to provide desired texture to the surface. This etching is most conveniently performed for substrates to be used in lithographic plates at the same time in which silicating of the substrate is being effected. This can be accomplished by using known alkaline silicate solutions which will etch and deposit a silicate coating at the same time. Where no silicating is required or where the subsequently applied light sensitive composition would not be compatible with a silicate surface, the etch may be performed in alkaline phosphate or aluminate solutions, for example. The aluminum or aluminized substrate should initially have a texturized surface so that etching of the ceramic coating will restore the relief provided by the underlying texture under the ceramic coating and provide additional microscopic texture. This texture from both sources, which is a microscopic texturing visible by light scattering or under magnification, provides a physical structure to which subsequently applied light sensitive coating compositions may adhere. Any of the available known processes for providing texture to the substrate may be used, but it is preferred to use mechanical graining such as slurry brush graining.

The post-firing etch may remove whatever amount of the dehydrated ceramic coating is necessary to provide the character required in the texture of the substrate. As little as five percent and as much as sixty percent by weight or more of the ceramic coating may have to be removed, but generally between fifteen and fifty percent of the coating is removed, and preferably between twenty-five and forty percent is removed. The length of time of the etch is regulated by the temperature and pH of the etching environment. Higher temperatures and higher pH levels provide faster etches. The pH may be controlled by the addition of alkaline hydroxides such as sodium or potassium hydroxide. Replenishing solutions may be added during the continuous processing operation to replace any material, such as the alkali component, which is depleted during the etch. The combined etch and silicating solutions are generally optimized to emphasize the silicating treatment, since the silicate etch has a wider performance latitude than phosphate or aluminate etching solutions. The silicates used for the combined etching and silicating baths are preferably at the high silica content end of the commercially available materials. Such materials as "Kasil #1" or "S-35" of the Philadelphia Quartz Co. or mixtures of "S-35" with a fine silica sol (e.g., "Nalcoag #1115" of Nalco Chemical Co.) are particularly useful when diluted with water to give solutions having approximately one percent silica on a dry weight basis.

The texturized substrates produced by the etching of the ceramic coated aluminum or aluminized substrate may then be coated with a light sensitive composition. An oligomeric diazonium resin and/or an organic negative acting photosensitive composition may be desirably applied to the textured surface.

The surface provided on the aluminum substrate is highly water receptive and has been shown to be at least as hydrophilic as anodized aluminum. The surface provides excellent adhesion for polymeric and oligomeric compositions. The surface has been found to provide excellent adhesion for positive acting photosensitive compositions such as those containing diazo oxides and diazo sulfides.

The thickness of the ceramic coating can readily be varied as desired, for example, between 0.2 and 15 micrometers. Preferably, for use as a substrate for planographic printing plates, the coating layer is between 0.3 and 10 micrometers and more preferably is between 0.5 and 5 micrometers.

The firing temperatures used in the practice of the present invention must be higher than 450° or 500° F. (230° or 260° C.) and preferably are at least 550° F. (285° C). Temperatures higher than 700° F. (370° C.) do not offer any significant advantages and tend to raise the energy requirements of the process. The firing should be performed for a long enough period of time at these temperatures to insure substantially complete dehydration of the dried coating. This may take place in as little as fifteen seconds dwell time at the described temperatures depending upon the thickness of the coating and the temperature and other parameters of the firing process. These temperatures refer to the surface temperature of the coating as measured by contacting that surface with the bare junction of a thermocouple. The surface temperature may vary quite markedly from the control temperature of various ovens and so this type of measurement is desirable.

Particulate matter such as magnesium oxide, silica, alumina, chromia, and ferric oxide may be added to the monoaluminum phosphate slurry with consequent benefits. The addition of some of these materials, such as magnesium oxide and alumina in particular, provide increased resistance to attack from basic developers and provide additional qualities to the graininess of the coating layer. This improvement is the subject matter of assignee's copending U.S. patent application Ser. No. 299,720, filed on Sept. 8, 1981, as this application in the name of L. A. Brey and D. E. Cadwell now abandoned. Flocculation inhibitors such as gluconic acid may also be added to the slurry, but alkaline dispersants such as alkali phosphates are not preferred even though they do not destroy the function of the present invention.

The process can be readily performed in a continuous manner and has been found to provide satisfactory results when performed in this fashion on a web.

Lithographically useful compositions may, of course, be coated on the coated surface. Such compositions would comprise (1) oligomeric diazonium resins, (2) positive acting diazo oxides or esters, (3) photopolymerizable organic compositions (particularly such as ethylenically unsaturated materials in the presence of free radical photoinitiators), (4) oligomeric diazonium resin undercoats with photopolymerizable organic composition overcoats, and (5) any other various well known lithographically useful photosensitive compositions.

These and other aspects of the present invention will become apparent from the following examples.

EXAMPLE 1

A precleaned, ungrained aluminum foil was coated with a solution of 25 weight percent monoaluminum phosphate in water and dried above 100° C. to a coating thickness of about 3 micrometers. The surface temperature of the coating was raised to 550° F. (260° C.) in ninety seconds in an oven and removed after thirty seconds at that temperature. A positive acting photosensitive composition as described in Example 3 of U.S. Pat. No. 4,247,616 was coated onto the treated surface after rinsing and drying. The composition adhered well to the substrate and developed off cleanly after exposure.

EXAMPLE 2

A precleaned, ungrained aluminum foil was coated with a composition comprising, by weight, 12% alumina (nominally 0.5 micrometers diameter), 15% monoaluminum phosphate, 0.75% magnesium oxide (particle size less than 200 mesh), and 72.25% water. The coating was dried to a thickness of about 3 micrometers.

The coated film was placed in an oven and the surface temperature of the coating was raised to 550° F. (260° C.) in thirty seconds. Dwell time in the oven was one and one half minutes. The coated film was cooled, rinsed, and dried, then rolled up.

The foil was subsequently unrolled and coated with the positive acting photosensitive composition of the previous example. The photosensitive layer adhered well to the substrate and developed off cleanly with no undesirable undercutting of the half tone image.

EXAMPLE 3

The procedure of Example 2 was repeated except that 1% zinc oxide was used in place of the magnesium oxide and correspondingly less water was used. The coated aluminum was found to be somewhat less resistant to developer chemicals than the sheet of Example 2, but still provided excellent adherence to the photosensitive layer and provided a useful printing plate surface.

EXAMPLE 4

The procedure of Example 2 was repeated, using the same coating composition, but with firing effected at 600° F. (310° C). No differences were observed between the mechanical or chemical properties of the materials. Both were presumed to be fully dehydrated.

EXAMPLE 5

An aluminum foil similar to that of the previous examples except roughened by a rotary brush fed with an abrasive slurry such as pumice, to give a mechanically abraded, lithographically useful surface texture as is well-known in the art, was coated with a solution of 25 weight percent monoaluminum phosphate in water, dried one minute in still air at 300° F., a second minute at 300° F. in moving air, and fired for one minute during which the surface temperature rose to 550° F. The coated film was then immersed 90 seconds in a solution containing 4.8% by weight of "Kasil #1" brand potassium silicate solution (Philadelphia Quartz Co.), 0.03% potassium hydroxide, and the balance water, at 95° C. The silicate treated foil was rinsed in a spray of deionized water for 30 seconds, dried, and coated with a 12 micron negative acting photopolymeric composition having acrylate monomers and a photosensitizer. Upon being mounted side-by-side as a half plate, the other half being a factory-made plate of the same photopolymer composition on standard anodized aluminum, and run for thousands of impressions, the aluminum phosphate coated plate gave at least as many good impressions before showing wear, as the factory-made anodized plate.

EXAMPLE 6

A grained aluminum foil prepared, phosphate coated and fired as in Example 5, and similarly etched except in a 5.25 weight percent solution of Philadelphia Quartz S-35 sodium silicate in water, coated with the same imageable layer and tested similarly, also equalled the performance of the commercial anodized plate.

EXAMPLE 7

A grained aluminum foil prepared, phosphate coated and fired as in Example 5, and similarly etched escept in a pH 10.4 solution of sodium pyrophosphate at 70° C., was coated with a positive-working photopolymeric composition, and tested similarly against a factory-made plate. It gave several times as many copies before showing wear as the Tartan 25 plate, which is brush grained similarly to the experimental plate but is not hard coated or anodized.

EXAMPLE 8

A grained aluminum foil prepared, phosphate coated and fired as above, was etched as above except in a pH 10.4 solution of "Nalco 680" sodium aluminate, made by the Nalco Chemical Co., and tested similarly. It gave several times as many copies before showing wear as the factory-made plate.

What is claimed is:

1. An article comprising an aluminum or aluminized substrate bearing on at least one aluminum or aluminized surface thereof a ceramic coating comprising a polymeric form of aluminum phosphate or mixtures of aluminum phosphates, said coating being substantially free of particulate material, wherein a photosensitive layer is coated on said ceramic layer.

2. The article of claim 1 wherein said coating is between 0.5 and 5 micrometers.

3. The article of claim 1 wherein said aluminum or aluminized substrate has a lithographically useful microscopic texture on said at least one surface bearing the ceramic coating.

4. The article of claim 3 wherein the ceramic coating has been etched in an alkaline solution, rinsed and dried.

5. The article of claim 1 wherein said coating is between 0.2 and 15 micrometers and said aluminum is in the form of a film or sheet.

6. The article of claims 1, 3, 4, or 5 wherein said photosensitive layer comprises organic polymerizable composition coated on said ceramic layer.

7. The article of claims 1, 3, 4, or 5 wherein said photosensitive layer comprises an oligomeric diazonium resin coated on said ceramic layer.

* * * * *

UNITED STATES PATENT AND TRADEMARK OFFICE

CERTIFICATE OF CORRECTION

PATENT NO. : 4,420,549

DATED : December 13, 1983

INVENTOR(S) : Donald E. Cadwell

It is certified that error appears in the above—identified patent and that said Letters Patent is hereby corrected as shown below:

Col. 7, line 7, "polymeric" should read -- polymorphic --.

Signed and Sealed this

*Eighth* Day of *May 1984*

[SEAL]

*Attest:*

GERALD J. MOSSINGHOFF

*Attesting Officer*

*Commissioner of Patents and Trademarks*